United States Patent [19]

Root

[11] 4,432,398

[45] Feb. 21, 1984

[54] WRAPAROUND ADJUSTABLE CENTER BRACE ATTACHMENT

[75] Inventor: Stephen J. Root, Mauldin, S.C.

[73] Assignee: Steel Heddle Manufacturing Company, Greenville, S.C.

[21] Appl. No.: 388,893

[22] Filed: Jun. 16, 1982

[51] Int. Cl.[3] ..... D03C 9/06

[52] U.S. Cl. ..... 139/91

[58] Field of Search ..... 139/91, 92

[56] References Cited

U.S. PATENT DOCUMENTS

| | | | |
|---|---|---|---|
| 2,211,271 | 8/1940 | Kaufman | 139/92 |
| 3,970,114 | 7/1976 | Baumann | 139/91 |
| 4,060,102 | 11/1977 | Kaufman | 139/91 |
| 4,112,980 | 9/1978 | Bader | 139/92 |

*Primary Examiner*—Henry Jaudon

*Assistant Examiner*—Tracy Graveline

*Attorney, Agent, or Firm*—Dority & Flint

[57] ABSTRACT

An adjustable wraparound sleeve A member is disclosed for attaching a center brace 26 between top and bottom frame slats 16, 18 on a heddle frame 10 of a loom. The sleeve member may be adjusted longitudinally on the frame slat and set in place by means of locking members 56 having means C for access from above each sleeve member 30, 32 with respect to vertical arrangement of the heddle frame 10 on the loom. The locking members 56 clamp the top and bottom frame slats 16 and 18 between block elements 44 and 50 in each sleeve member 30, 32. Each block element 44, 50 is threaded to receive locking members 56 from the top of either slat so that the sleeve member A may be interchangeably used on either slat.

5 Claims, 3 Drawing Figures

WRAPAROUND ADJUSTABLE CENTER BRACE ATTACHMENT

BACKGROUND OF THE INVENTION

The invention relates generally to a heddle frame construction for a loom and specifically to attachment of the center brace between the top and bottom frame slats of the heddle frame in a manner in which the position of the center brace longitudinally along the frame slats may be adjusted to accommodate different widths of fabric.

Typically, the heddle frame includes a pair of side frames with the top and bottom frame slats being vertically spaced and fixed by the side frames. Heddle rods are carried between the side frames and are attached to the frame slats between which the heddles are carried in the frame. Individual warp yarn ends are threaded through the individual heddles whereby the warp yarn ends are raised and lowered to form a shed during weaving. Any number of heddle frames may be utilized on a loom in side-by-side close proximity to each other. The heddle frames are reciprocated up and down during shedding by means of a heddle drive assembly positioned below the heddle frames. The bottom frame slat is adapted for making driving connection with the heddle frame drive assembly.

Center braces are attached between the top and bottom frame slats across the width of the heddle frame to maintain the top and bottom frame slats parallel and rigid with respect to one another. The number of center braces required depends upon the width and number of pieces of fabric being woven on the loom. Normally, a center brace is located between each fabric width that is being woven on the frame.

U.S. Pat. No. 3,970,114 discloses a guide element fitted on the frame slats of a heddle frame which may be adjusted in its longitudinal position across the length of the frame slat. However, the element is not adapted for bracing or attaching a center brace and is not readily accessible for adjustment when attached to the bottom frame slat.

U.S. Pat. No. 4,112,980 discloses a holder element for mounting a center brace between the top and bottom frame slats of a heddle frame and provides for limited adjustment.

However, the problem occurs in prior center brace mounts, that the mounting elements are not readily accessible for adjustment. This becomes a particular problem on the bottom frame slat where the heddle frame drive mechanism is connected to the bottom frame slat and, therefore, access to the parts of the bottom frame slat may not be readily had from the lower portion or from below the frame slat. When considering that upwards of eighteen heddle frames may be disposed on a loom in close proximity and may be in different up and down positions, the problem of providing adjustable mountings for the center brace which are operationally accessible on each heddle frame slat becomes one which needs considerable attention.

Accordingly, an important object of the present invention is to provide means for attaching the center brace between the top and bottom frame slats of a heddle frame in which the center brace may be adjusted along the frame slats and set in position in a simple and expedient manner.

Another important object of the present invention is to provide wrap-around attachment members for attaching the center brace of a heddle frame between the top and bottom frame slats which may be released and set in position by means of simple clamping means which is readily accessible vertically from the upper sides of both the top and bottom frame slats.

Still another important object of the present invention is to provide wrap-around attachment means for attaching a center brace between the top and bottom frame slats of a heddle frame which may be interchangeably used on either the top or bottom frame slat and may be adjusted from the upper side thereof in either position.

SUMMARY OF THE INVENTION

The above objectives are accomplished according to the present invention by means of a pair of sleeve members which wrap around the top and bottom frame slats to secure a center brace therebetween in any position adjusted along the length of the frame slats. Each sleeve member includes a first end which hooks upon a block element attached to each end of the center brace. A second block element is carried in a second opposing end of each sleeve member between which the heddle frame slat is clamped. The first and second block elements include threaded vertical bores so that either sleeve member may be utilized on the top or bottom frame slat. The second block element of the upper sleeve member carried on the top frame slat is provided with a threaded locking member and the first block element of the lower sleeve member carried on the bottom frame slat is likewise provided with a threaded locking member. A thrust washer plate is carried between the threaded locking members and opposing frame slat surface which is urged against the respective frame slat surface. Means for accessing the threaded blocking members is provided from upper sides of both the top and bottom frame slats so that the threaded locking members may be operated from a vertical direction above the top and bottom frame slats. Thus, the sleeve members and the attached center brace may be adjusted longitudinally along the length of the frame slats without the need to disconnect or move the position of the heddle frame away from the heddle drive mechanism regardless of the number of heddle frames utilized side-by-side. It has been found that such provides a simple accessible and convenient means of attaching the center brace and adjusting the center brace in its position.

BRIEF DESCRIPTION OF THE DRAWINGS

The construction designed to carry out the invention will be hereinafter described, together with other features thereof.

The invention will be more readily understood from a reading of the following specification and by reference to the accompanying drawings forming a part thereof, wherein an example of the invention is shown and wherein.

DESCRIPTION OF A PREFERRED EMBODIMENT

Figures 1, 2, 3:
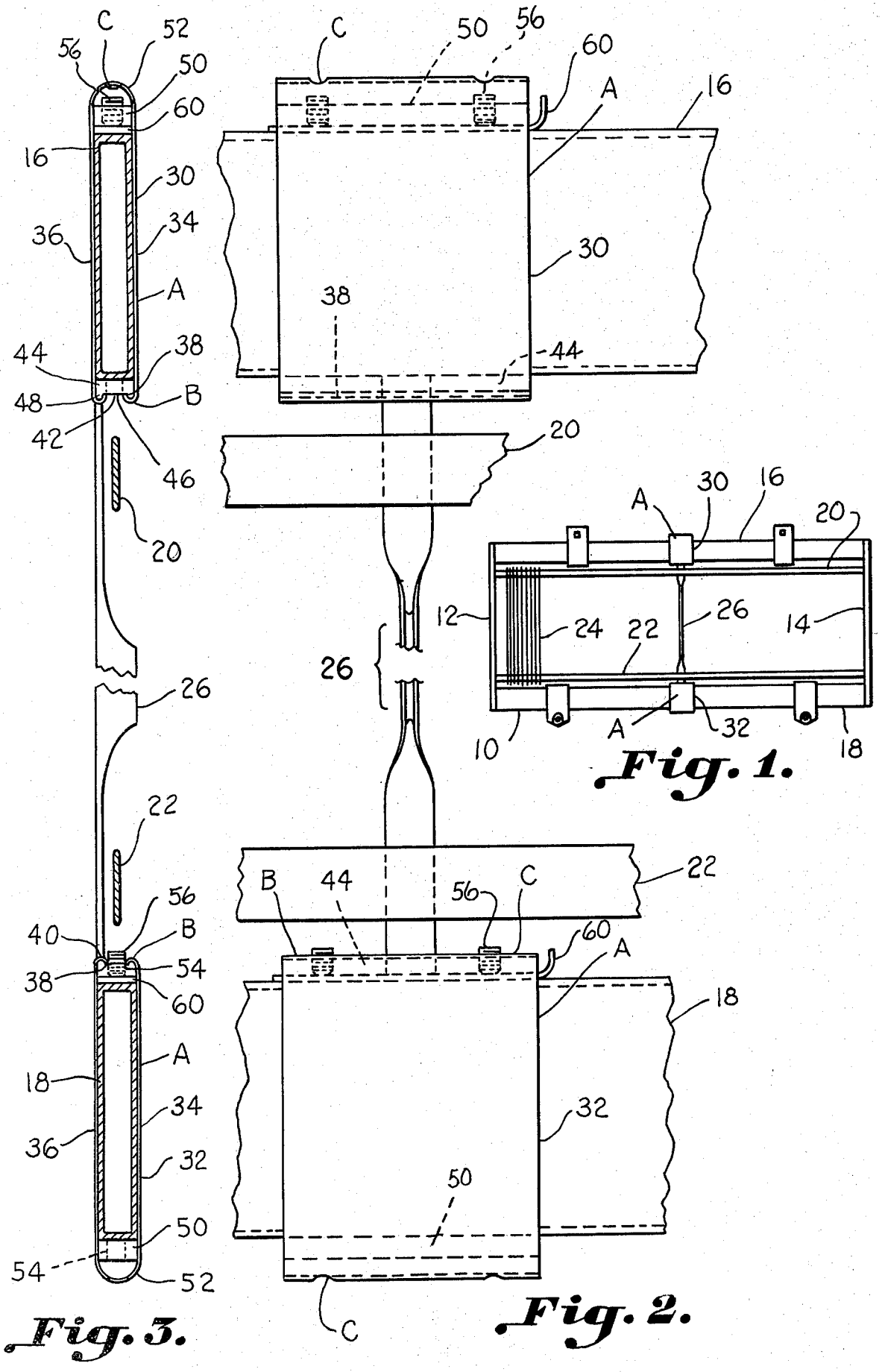
FIG. 1 is an elevation view of a heddle frame provided with center brace attachment means according to the invention.
FIG. 2 is an enlarged partial view of a heddle frame illustrating a center brace and adjustable wrap-around attachment means constructed according to the present invention.
FIG. 3 is an end view of FIG. 2.

The invention relates to a heddle frame construction for a loom. Since the construction of the loom and its operation are well known, only so much of the heddle frame and loom as is necessary to an understanding of the invention are illustrated.

Accordingly, the drawing illustrates a heddle frame 10 having a pair of side frames 12 and 14. A top frame slat 16 and a bottom frame slat 18 extends between the side frames and are connected thereto in any suitable manner. Attached between the side frames 12 and 14 are a pair of heddle rods 20 and 22 which may also be attached to the top and bottom frame slats. The heddle rods support the heddles 24 in the frame which include a central heddle eye in which a warp yarn end is threaded.

Referring now in more detail to the drawing, the heddle frame 10 is illustrated as including a center brace 26 attached between the top and bottom frame slats 16 and 18, respectively, which maintains the frame slats parallel and generally rigid with respect to each other. In accordance with the invention, the center brace 26 is attached to the top and bottom frame slats in an infinitely adjustable manner along their length and in a manner in which the attachment means may be set and reset by locking and unlocking the attachment means from a vertical direction above each respective frame slat.

As illustrated, the attachment means includes a wrap-around sleeve member A which is attached to each of the top and bottom frame slats. A first wrap-around sleeve member 30 is carried by the top frame slat 16 and a second wrap-around sleeve member is carried by the bottom frame slat 18. Each sleeve body member includes a pair of spaced sides 34 and 36 adapted to wrap around the respective frame slats. The sides of each sleeve member A terminate in opposing edge portions B which, in turn, terminate in free ends 38 turned downwardly generally parallel to the sides of the sleeve member. The free ends thus form a hook portion 40 at a first end of the sleeve member.

An open longitudinal slot 42 is thus formed between the opposing edge portions B of each sleeve member across the first end thereof which is open to receive a frame slat therethrough. A first block element 44 is carried on each end of the center brace 26 which is secured thereto by any suitable means such as welding or being made as one piece therewith. The lock element includes an open groove 46 formed in an upper surface thereof defined by upstanding edge means 48 on each side of an open groove. The first block elements 44 are disposed between the opposing edge portions B of the first end of each sleeve member 30, 32 and the frame slats 16 and 18. The downwardly turned free ends 48 of the edge portion B is fitted and hooked over the edge means 48 of each of the first block elements 44. By this means, the center brace is fastened between the top and bottom frame slats.

A second block element 50 is carried adjacent a second end 52 of each said sleeve member A remote from the first end of the sleeve member. The second block element 50 may be fixed within the sleeve member in any suitable manner such as by welding. The first and second block elements 44 and 50 includes vertical threaded openings extending through the block elements.

Threaded lock members 56 are received in the threaded openings of the first block element 44 fitted within the second sleeve member 32 and the threaded openings 54 of the second block element 50 carried in the first sleeve member 30. The threaded locking members clamp the respective sleeve members against the top and bottom frame slats when tightened to a clamping position. Access means C is formed in the first and second ends of each sleeve member to provide access to the threaded locking members. The threaded locking members are operationally accessible through the access means from a vertical direction from above the top and bottom frame slats on each heddle frame as carried vertically on the loom. This facilitates adjustment of the longitudinal position of the center brace in each sleeve member on its respective frame slat without obstruction from the heddle frame drive assembly adjacently therebelow.

A thrust washer 60 is carried between the first block element 44 of sleeve member 34. A second thrust washer 60 is carried between the second block element 50 of sleeve member 30 in the top frame slat 16. The threaded blocking members urge the thrust washers against the frame slats when threaded and tightened in the clamping position to prevent damage to the frame slat.

While a preferred embodiment of the invention has been described using specific terms, such description is for illustrative purposes only, and it is to be understood that changes and variations may be made without departing from the spirit or scope of the following claims.

What is claimed is:

1. In a heddle frame construction for a loom of the type which includes a top and bottom frame slat, a heddle rod carried by each frame slat which support heddles in the frame, at least one center brace carried vertically between said top and bottom frame slats, said bottom frame slat being adapted for driving connection with a heddle frame drive assembly, an adjustable attachment element carried by said top and bottom slats attaching said center brace thereto comprising:

a first sleeve member slidably carried on said top frame slat;

a second sleeve member slidably carried on said bottom frame slat;

each said sleeve member including a pair of spaced sides wrapping around said respective frame slats;

said sides of each said sleeve member terminating in opposing edge portions at a first end thereof;

said opposing edge portions formed at said first ends of each said sleeve member terminating in free ends turned downwardly generally parallel to said sides of each sleeve member;

a longitudinal slot defined between said opposing edge portions of each said sleeve member across said first end of said sleeve member being open to receive said frame slat therethrough;

a first block element carried on opposing ends of said center brace including an open groove formed in an upper surface thereof defined by upstanding edge means on each side of said open groove;

one of first block elements being disposed between said opposing edge portions of said first end of each said sleeve members;

said downwardly turned free ends of said edge portion of said first end of each said sleeve member fitting over said edge means of said first block elements fastening said center brace between said top and bottom frame slats;

a second block element carried adjacent a second end of each said sleeve member remote from said first end of said sleeve member;

said first and second block elements having vertical threaded openings extending through said block elements;

threaded lock members received in said threaded openings of said first block element fitted within said second sleeve member and said threaded openings of said second block element carried within said first sleeve member;

said threaded lock members clamping said sleeve members against said respective frame slats when in a tightened clamping position;

access means formed in said second end of said first sleeve member and in said first end of said second sleeve member;

said threaded locking member being operationally accessible through said access means from a vertical direction from above said top and bottom frame slats on said heddle frame carried vertically on said loom facilitating adjustment of the longitudinal position of each said sleeve member on said respective frame slats without obstruction from the heddle frame drive assembly adjacently therebelow.

2. The apparatus of claim 1 including a first thrust washer carried between said first block element fitted in said second sleeve member and said bottom frame slat and a second thrust washer carried between said second block element of said first sleeve member and said top frame slat which are urged against frame slats when said threaded members are tightened in said clamping position.

3. The apparatus of claim 1 wherein said access means includes said longitudinal slot of said second sleeve member carried on said bottom frame slat of said heddle frame and includes openings defined by cut-outs in said second end of said first sleeve member carried on said top frame slat.

4. In a heddle frame construction for a loom of the type which includes a top and bottom frame slat, a heddle rod carried by each frame slat which support heddles in the frame, at least one center brace carried vertically between said top and bottom frame slats, said bottom frame slat being adapted for driving connection with a heddle frame drive assembly, an adjustable attachment element carried by said top and bottom slats attaching said center brace thereto comprising:

sleeve means slidably carried on said top frame slat and said bottom frame slat;

said sleeve means wrapping around said respective frame slats and including opposing edge portions having hook means engaging said slats;

a longitudinal slot defined between opposing edge portions across a first end of said sleeve means;

a first block means carried on opposing ends of said center brace including an open groove formed in an upper surface thereof defined by upstanding edge means on each side of said open groove;

said hook means fitting over said edge means of said first block means fastening said center brace between said top and bottom frame slats;

second block means carried adjacent a second end of each said sleeve means remote from said first end of said sleeve means;

said first and second block means having vertical threaded openings extending therethrough;

threaded locking means received in said threaded openings of said first and second block means;

said threaded locking means clamping said sleeve means against said frame slats when in a tightened clamping position;

access means formed in said first means;

said threaded locking means being operationally accessible through said access means from a vertical direction from above said top and bottom frame slats on said heddle frame carried vertically on said loom facilitating adjustment of the longitudinal position of each said sleeve means on said frame slats without obstruction from below the heddle frame.

5. The apparatus of claim 4 wherein said sleeve means includes a first sleeve member wrapped around said top frame slat and a second sleeve member wrapped around said bottom frame slat, said first and second sleeve members being interchangeable on said top and bottom frame slats, said threaded lock members being receivable in said block means on either of said first or second ends of each said sleeve means facilitating said interchangeable use.

* * * * *